US007336565B2

(12) United States Patent
Rohrbacker et al.

(10) Patent No.: US 7,336,565 B2
(45) Date of Patent: Feb. 26, 2008

(54) TALKING ALARM CLOCK

(76) Inventors: Neil Rohrbacker, 3 Knollwood Ave., Madison, NJ (US) 07940; Gregory Rohrbacker, 3 Brynwood Ct., Gladstone, NJ (US) 07934-2080

( * ) Notice: Subject to any disclaimer, the term of this patent is extended or adjusted under 35 U.S.C. 154(b) by 59 days.

(21) Appl. No.: 11/451,093

(22) Filed: Jun. 12, 2006

(65) Prior Publication Data

US 2007/0286029 A1 Dec. 13, 2007

(51) Int. Cl.
*G04B 21/08* (2006.01)

(52) U.S. Cl. ..... 368/63; 704/269; 704/274; 368/10

(58) Field of Classification Search ..... 368/63
See application file for complete search history.

(56) References Cited

U.S. PATENT DOCUMENTS 4,498,787 A * 2/1985 Jung-Sun ..... 368/10
4,701,862 A * 10/1987 Washizuka et al. ..... 704/274
2005/0243658 A1* 11/2005 Mack ..... 368/223

* cited by examiner

*Primary Examiner*—P. Austin Bradley
*Assistant Examiner*—Thanh S. Phan
(74) *Attorney, Agent, or Firm*—Charles E. Baxley

(57) ABSTRACT

An educational alarm clock radio is provided that speaks a new word each day when the alarm goes off, the words each being stored in a memory cartridge as an individual increments of information in a sequential set of increments. When the alarm goes off, the word of the day, the definition of that word of the day and its use in a sentence are spoken via the audio portion of the device as the next information increment in the sequence. The word will also be displayed on a screen so the user can see the correct spelling of the word. The word may be replayed at any time during the day by activating a device control. Prior words may be displayed by energizing a reverse control. The entire sequence of previously played words, moreover, can be played in serial fashion through further activation of control or combination of controls. The device also serves as an alarm clock radio with alarm types such as wake by buzzer or radio as well as the wake by words function. The device has a snooze control, which will suspend the audio function of the device for a predetermined time, at which time the audio will replay. This may be repeated any number of times. The snooze control will also repeat a predetermined group of the last words in the sequence encoded in the cartridge. Some cartridges will have sequential information increments that are specific to a particular test (i.e. SAT, MCAT), a foreign language, or a particular theme such as history or science.

9 Claims, 8 Drawing Sheets

TALKING ALARM CLOCK

STATEMENT REGARDING FEDERALLY SPONSORED RESEARCH OR DEVELOPMENT

None

JOINT RESEARCH AGREEMENT PARTNER

None

REFERENCE TO "SEQUENCE LISTING"

None

BACKGROUND OF THE INVENTION

The present invention relates to a clock and learning aid combination. The dictionary has been an important part of a children's education both in school and at home. Research claims that a person can memorize three to four words at a time. Out of these words, only one or two will remain in the long-term memory. It is, therefore, a natural conclusion that children, as well as adults, who use dictionaries often will have a larger vocabulary than those who do not.

For a person conscientious about education, an electronic form of a dictionary would be of great benefit. Such dictionary is useful as a time saving device and also a space saving device. Electronic dictionaries were described as early as 1979 in Levy, U.S. Pat. No. 4,158,236. In the 1990's computer technology made possible the release of dictionaries on computer discs, CD-ROM and as part of multivolume reference-book packages.

Dictionaries, however, are designed to provide reference upon need. Once a person comes across a word for which the meaning is not known, the meaning will be sought in a dictionary. But one would not typically read the dictionary for the sole purpose of enhancing one's vocabulary. This is especially true for children.

Published U.S. Pat. Application 2004/0029091 to M. Gitman published Feb. 12, 2004, for "Clock-Learning Aid and Combination" shows a clock-learning aid combination that displays learning materials on the face of the clock. It is a combination of a clock and a display of a thesaurus or other learning materials. The content may be arranged according to different linguistic levels, to suit various ages and topics. The learning material display item appears at a rate selected by the user and because the user would look at the clock frequently throughout the day, memorization of the vocabulary would likely occur.

U.S. Pat. No. 5,199,099 to G. Svast granted Mar. 30, 1993, for "Reminder Clock" shows a programmable clock including a memory for storing times, dates and messages for subsequent read-out and display in providing a reminder of a birthday, anniversary, doctor's appointment, meeting, and the like. The invention alerts a user to stored messages at designated times. The reminder clock also includes a speaker and an audio recorder for providing a reminder message in the user's own voice. The reminder clock makes use of any one of several analog and combined analog and digital time displays. Various audio and/or video alarms are provided to indicate the read-out and display of a reminder message. The clock will alert the user to stored messages at designated times.

BRIEF SUMMARY OF THE INVENTION

The present invention is of great assistance for those who lack time or motivation to review a dictionary or other learning resource. A clock is an item that people look at numerous times during a day and thus they are forced in a way to learn new words or other increments of information. The present invention, moreover, overcomes the limitations of the prior art by providing a talking alarm clock that uses speech in lieu of an alarm.

A salient feature of the present invention is to provide an educational talking alarm clock that uses speech in lieu of a buzzer and/or radio. The clock is programmable and includes a memory for storing the message to be played. When the alarm is programmed, the clock wakes-up the user at the designated time with a word or other information increment of the day. The clock, for example, includes a speaker so that the word and its definition is "spoken" or is expressed audibly by the clock. Then the word is displayed on a screen that is part of the clock. In this manner, the practice of the invention reinforces the users' information increment retention through stimulation not only of the user's sense of hearing, but also of the user's sense of sight. The word may be repeated by pressing a button. In one embodiment, the clock would be for use by children, and may contain age appropriate vocabulary. In further embodiments, the clock can provide words that are more adult and give examples of ways to use the word in conversation along with the definition. The clock may use any one of several analog or digital time displays.

BRIEF DESCRIPTION OF THE DRAWING

A preferred embodiment of the invention will now be described with reference to the accompanying drawings in which.

DETAILED DESCRIPTION OF A PREFERRED EMBODIMENT OF THE INVENTION

Detailed descriptions of the preferred embodiment of the invention are provided herein. It is to be understood, however, that the present invention may be embodied in various forms. In one embodiment, the present invention is generally directed to an alarm clock radio that speaks a new word and/or phrase every day when the alarm is sounded or "goes off". When the alarm "goes off", the word and/or phrase, the definition of the word, and its use in a sentence will be spoken by the audio portion of the device. For the purpose of further description, this combination of a correctly spelled word and, as appropriate, one or both of the words' definition and the word's use in a sentence are referred to as a word. At the same time, the word may be displayed on a screen portion of the device so that the user can see the correct spelling. The user can replay the word, definition, and the like throughout the day by depressing a button on the clock. Words for previous days can be replayed as well by pressing another button. Further, all of the previously played words can be replayed in a serial manner. The device may also function as an ordinary alarm clock radio for regulating a timed cycle for displaying and expressing various alarm types, i.e. waking only by the buzzer and/or radio, as well as the wake-with-words functionality. The device further may comprise a snooze button. Depressing the snooze button will suspend the audio portion for a predetermined number of minutes, after completion of the speaking of the word, at which time it will replay. This may be repeated for any number of times.

The words, definitions, and the like are stored in a digital chip or memory cartridge. Each cartridge contains one or more sequential sets of individual increments of information as, for example, words specific to the age of the user, the cartridges, moreover, being easily replaceable. In addition to age appropriate cartridges, the cartridges may also be specific to certain subjects, foreign languages or tests (i.e. SAT, MCAT). In this respect, to use this invention to its best advantage, each individual increment of information in a sequential set of increments in any chosen field of knowledge is of a nature that is readily assimilatable by the user.

Figure 1C:
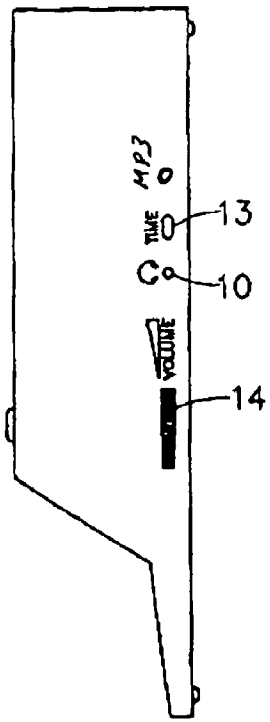
FIG. 1C is a side elevation of the embodiment of the invention shown in FIG. 1A.
Figure 1B:
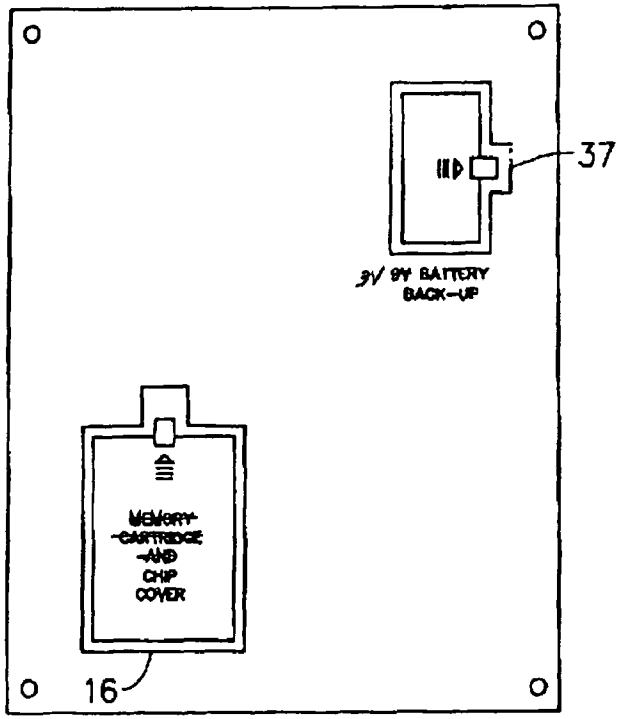
FIG. 1B is a bottom elevation of the embodiment of the invention shown in FIG. 1A.
Figure 1A:
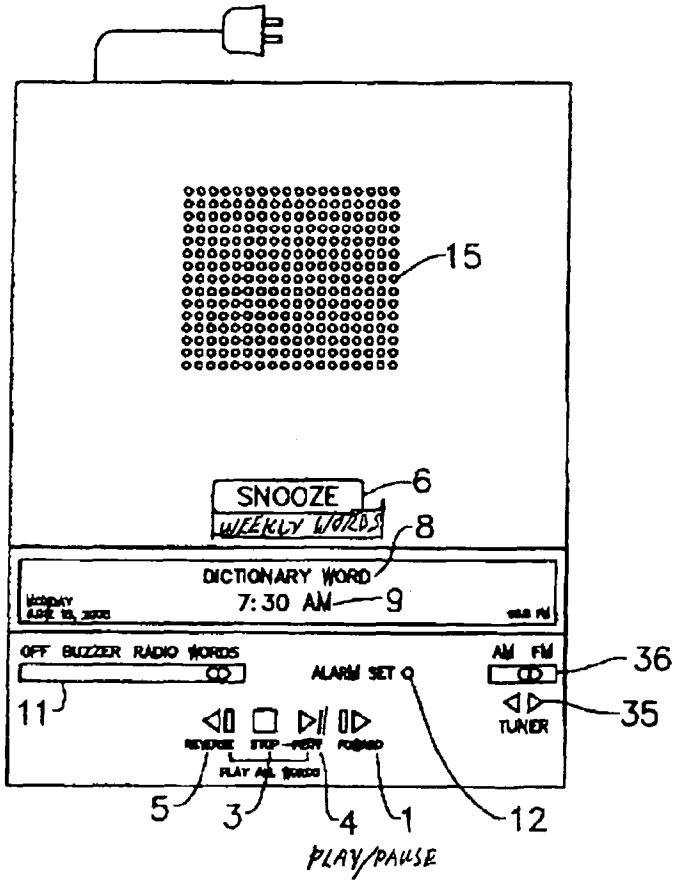
FIG. 1A is a plan view of a clock that characterizes the invention.

In the present invention, there is generally provided an alarm clock radio as shown in FIG. 1A, which has a time or clock control display 9, a word control display 8, and an audio control and speaker 15 for expressing information increments audibly. The alarm has alarm clock radio features, such as the time display 9, a volume control 14 (FIG. 1C), an alarm control or button 11 (FIG. 1A), a snooze control or button 6, a radio tuner 35, a switch 36 for selecting amplitude modulation (AM) or frequency modulation (FM) radio reception, and a band selector 36. Unlike typical alarm clock radios, however, the present invention has the word control 8 and audio control 15 for replaying the word of the day. It also has an area for a digital chip or a memory cartridge 16 (FIG. 1B) which may be changed with ease by the user.

Figure 2:
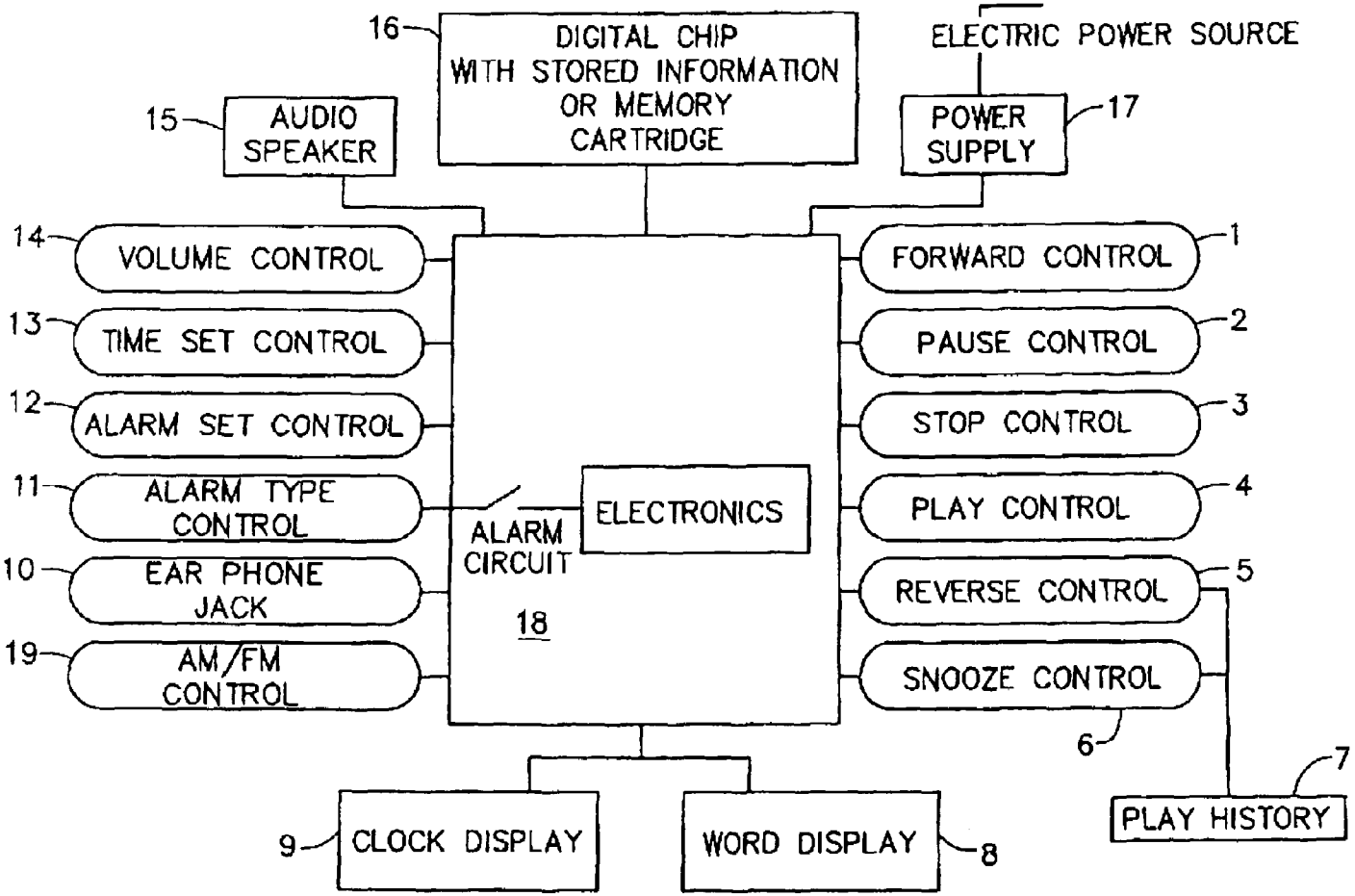
FIG. 2 is a schematic illustration of the components for the preferred embodiment of the invention shown in FIGS. 1A through 1C.

In accordance with the invention, the clock 9 (FIG. 1A) may provide many functions as subsequently described and as shown in FIG. 2. The user can activate a play control and button 4 (FIG. 1A) to play or replay and audibly express the audio portion of the word for the day. A reverse control and button 5 can then be activated to display the previous day's word or may be pressed multiple times to go as far back as the number of daily words already played. Then activating the play control 4 plays the definition of that word. A forward control and button 1 will display the next word in the sequence if the user has already gone back to previous words. If the reverse control 5 and play control 4 are energized simultaneously, a play history 7 (FIG. 2) will function and the device will start with the first word in the sequence of the words in the digital chip or on the memory cartridge 16 (FIG. 1C) and continuously play all previously played words. The alarm control 11 will energize an alarm circuit 18 (FIG. 2) as well as to dictate which alarm type will be active when the alarm is sounded (i.e. activating one or more of a radio, a buzzer, or a word). A stop control and button 3 (FIG. 1A) will stop the audio portion of the words. Time is set through a time set control and button 13 (FIG. 1C) that is activated while setting the time. The user will then also activate the forward 1 or reverse 5 control (FIG. 1A) to move the time to the appropriate time. An alarm set control 12 works similarly to the time set control 13 (FIG. 1C) and is set by the user for a specified time for the alarm circuit 18 (FIG. 2) to sound through the audio speaker 15 (FIG. 1A). Activation of the alarm circuit 18 (FIG. 2) is accomplished through setting the alarm control 12.

The snooze control 6 will turn off the alarm circuit 18 when energized by the user. If words are the selected alarm, the snooze control 6 will not deactivate the audio portion of the alarm until completing the spelled word, including where encoded in the memory cartridge 16 the spelled word's definition, and its use in a sentence. The alarm, moreover, will reactivate after a predetermined number of minutes. If the alarm type is set as a radio or buzzer, activating the snooze control 6 will immediately shut off the alarm circuit 18 for another predetermined number of minutes. The volume control 14 sets the audio speaker 15 volume of the radio, buzzer and speech of the spoken words. The clock may also contain an ear phone jack 10 for use with ear phones (not shown). The connection of ear phones to the clock 9 will automatically stop the speaker 15 from operating. The clock 9 may also have an input jack (not shown in the drawing) for playing MP3 players through the clock's speaker 15. The memory cartridge 16, which contains the sequence of individual information incremental words, are inserted into the clock 9. The words, moreover, are displayed in the word display 8 close to the time or clock display 9 in a static fashion.

In operation and as shown by the appropriately assembled flowchart from FIGS. 3A through 3E, with the clock turned on and running, the user begins by setting the alarm time energizing the alarm set control 12. The clock then runs normally. The new word for the day is displayed 34 at 12:00 a.m. When it is time for the alarm to go off 20, the word of the day is sounded in the play word 21 display along, when encoded, with the word's definition and usage, the word also being displayed visually 34. Snooze control activation 27 may also serve as another form of history play (that is, to play a pre-selected sequence of previously displayed words). When so activated 27 and not in the alarm mode, the clock 9 in the embodiment of the invention being described will play the last seven words in a serial sequence. The user activates pause 29 to stop the play when activated at any time by energizing play control 41, stop control 33 and pause control 29.

After the alarm goes off 20, the snooze control is energized 27. If snooze is activated 27, the alarm will continue to play the word until completed and be reset 28 to go off again in a predetermined period of time. Again, the word of the day will be sounded by the clock and be visually displayed 34.

Figure 3A:
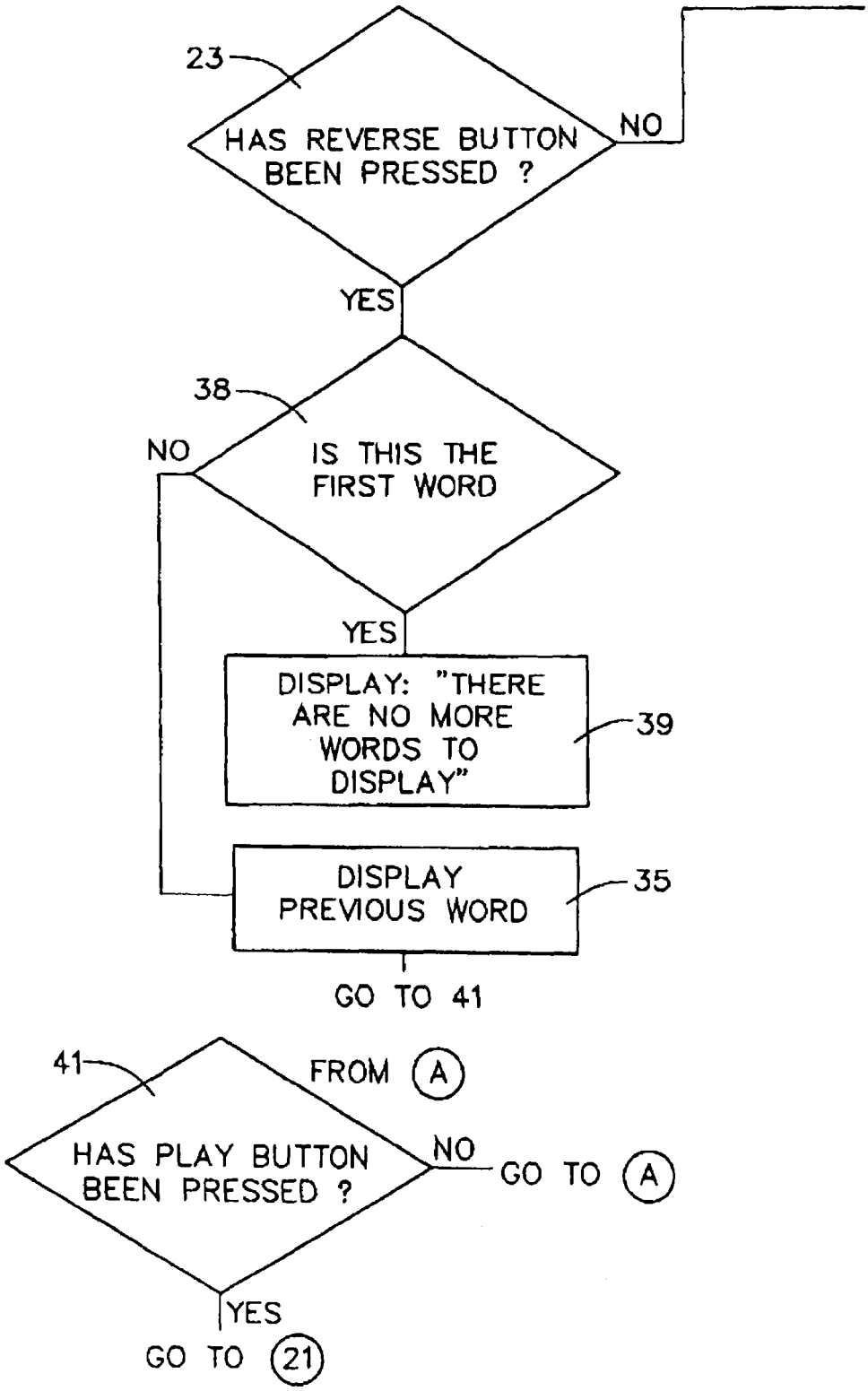
FIGS. 3A through 3E each are portions of a flowchart for utilizing the invention illustrated in FIG. 2, above.
Figure 3B:
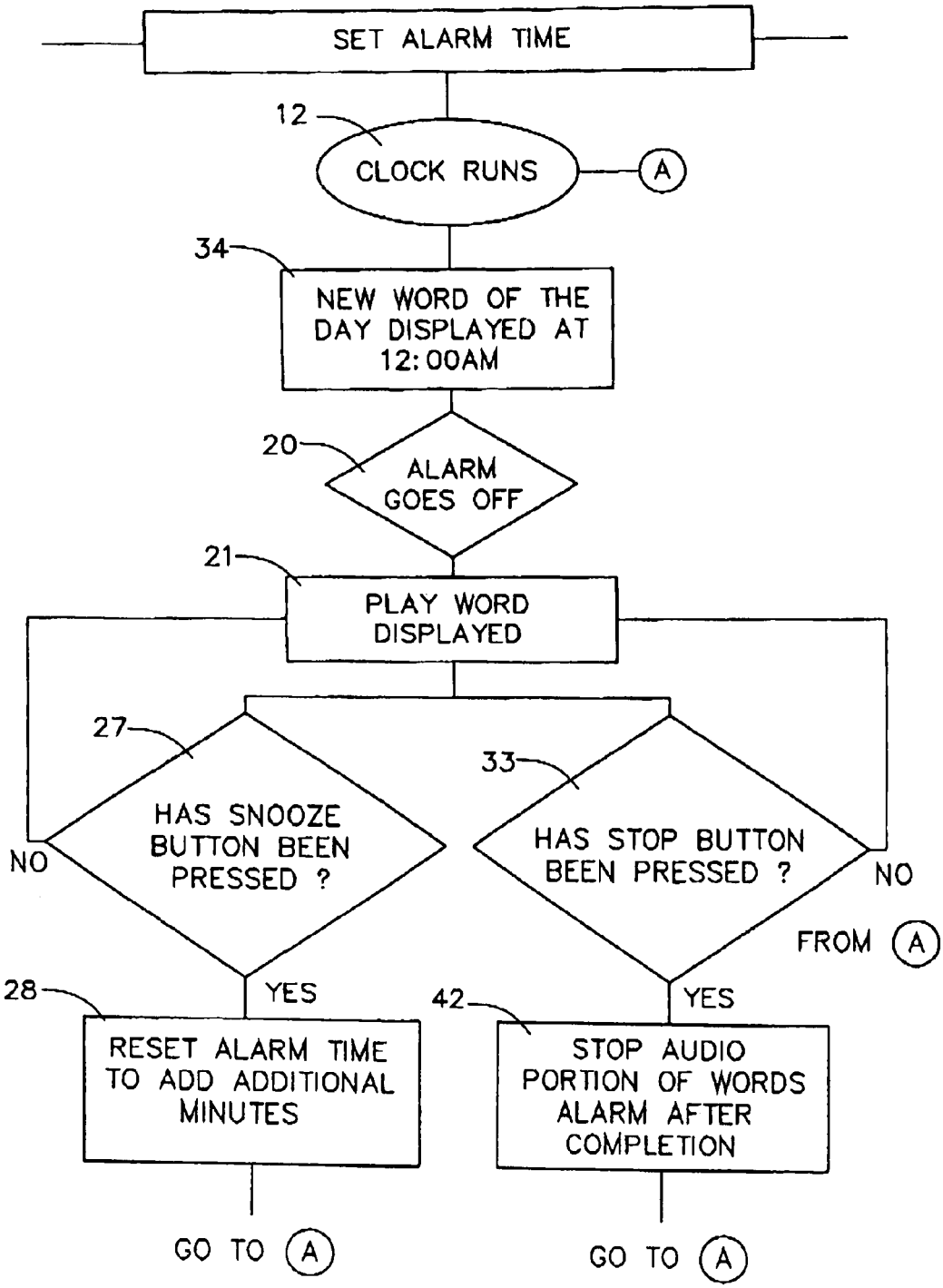
Figure 3C:
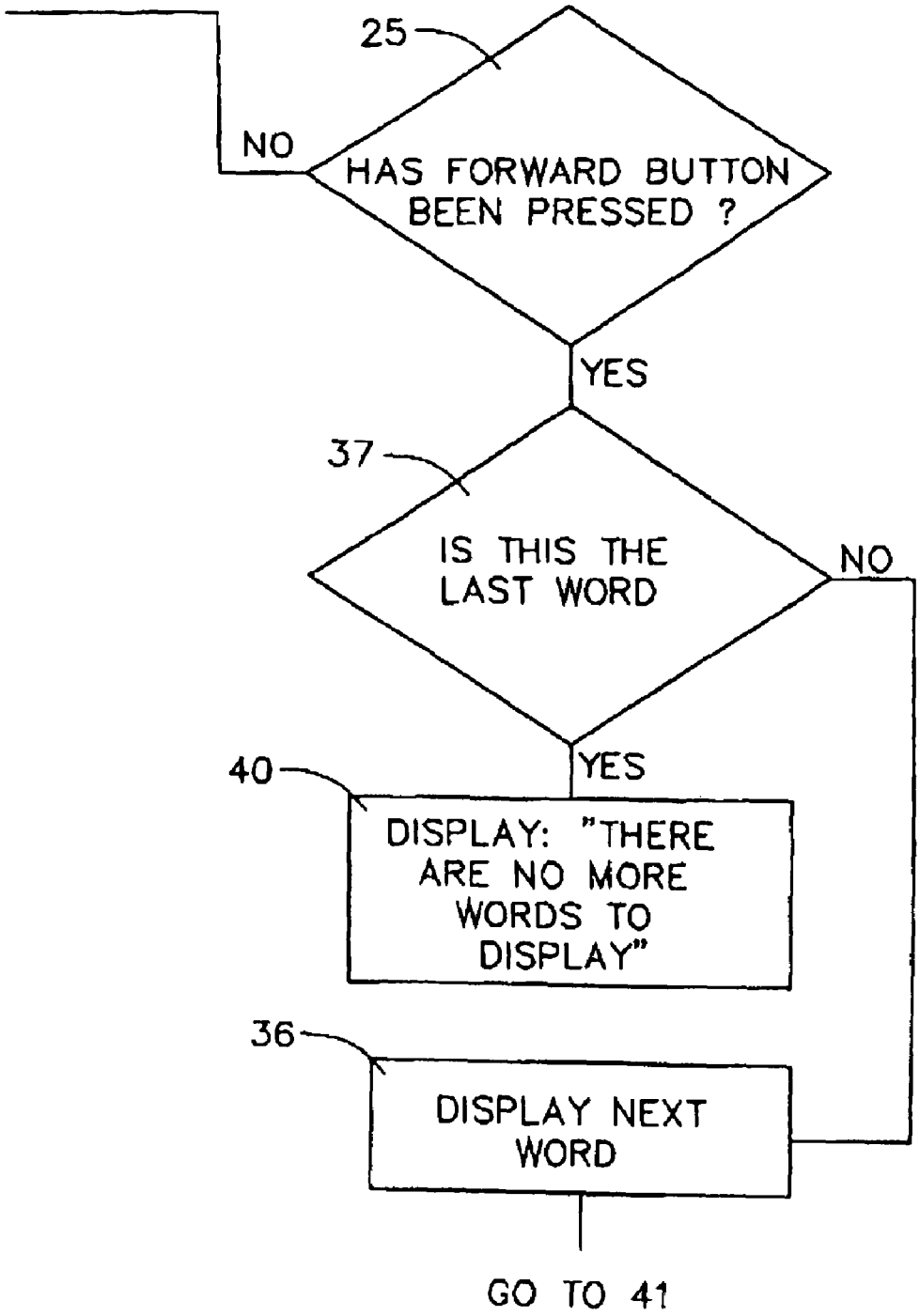
Figure 3D:
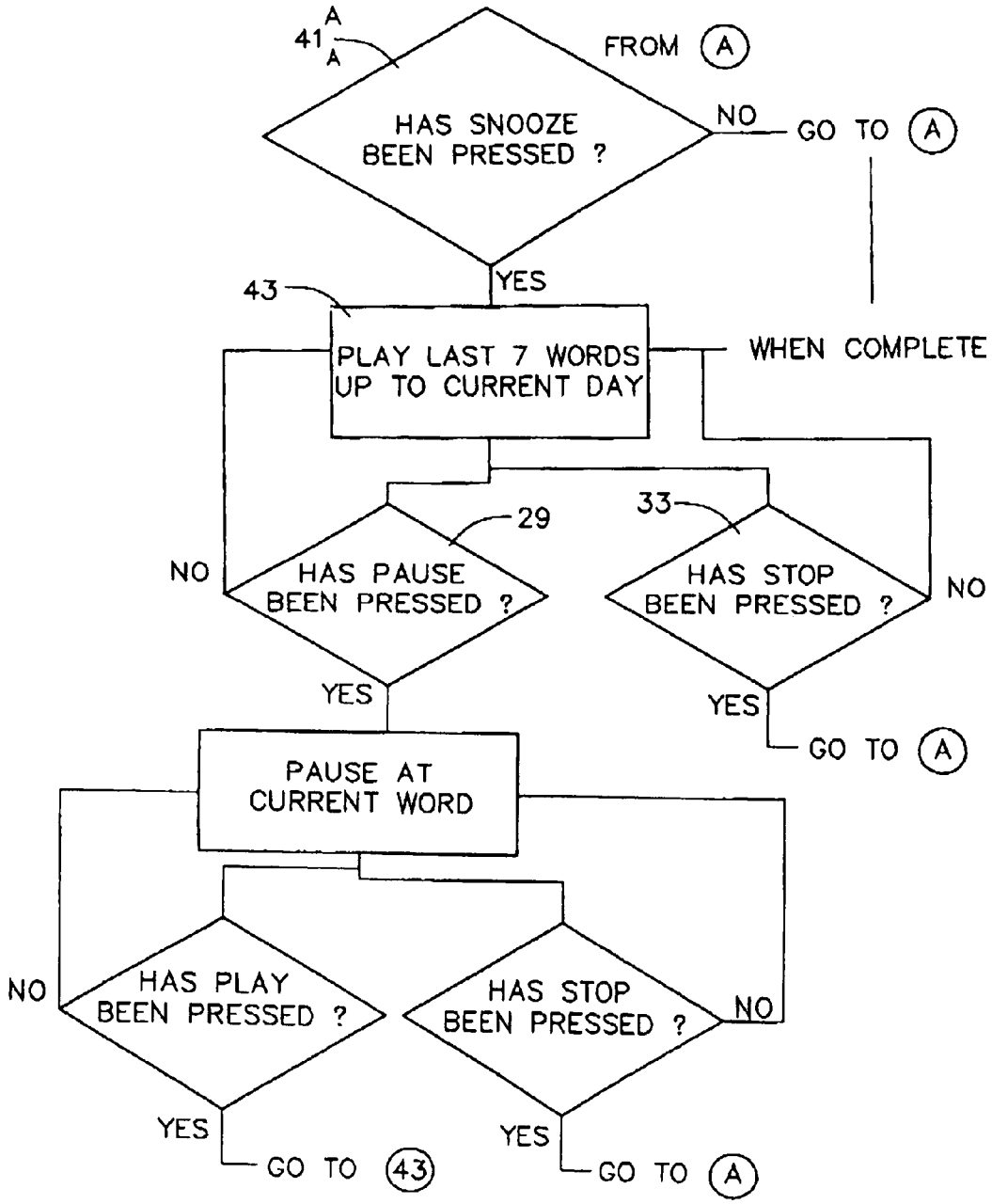
Figure 3E:
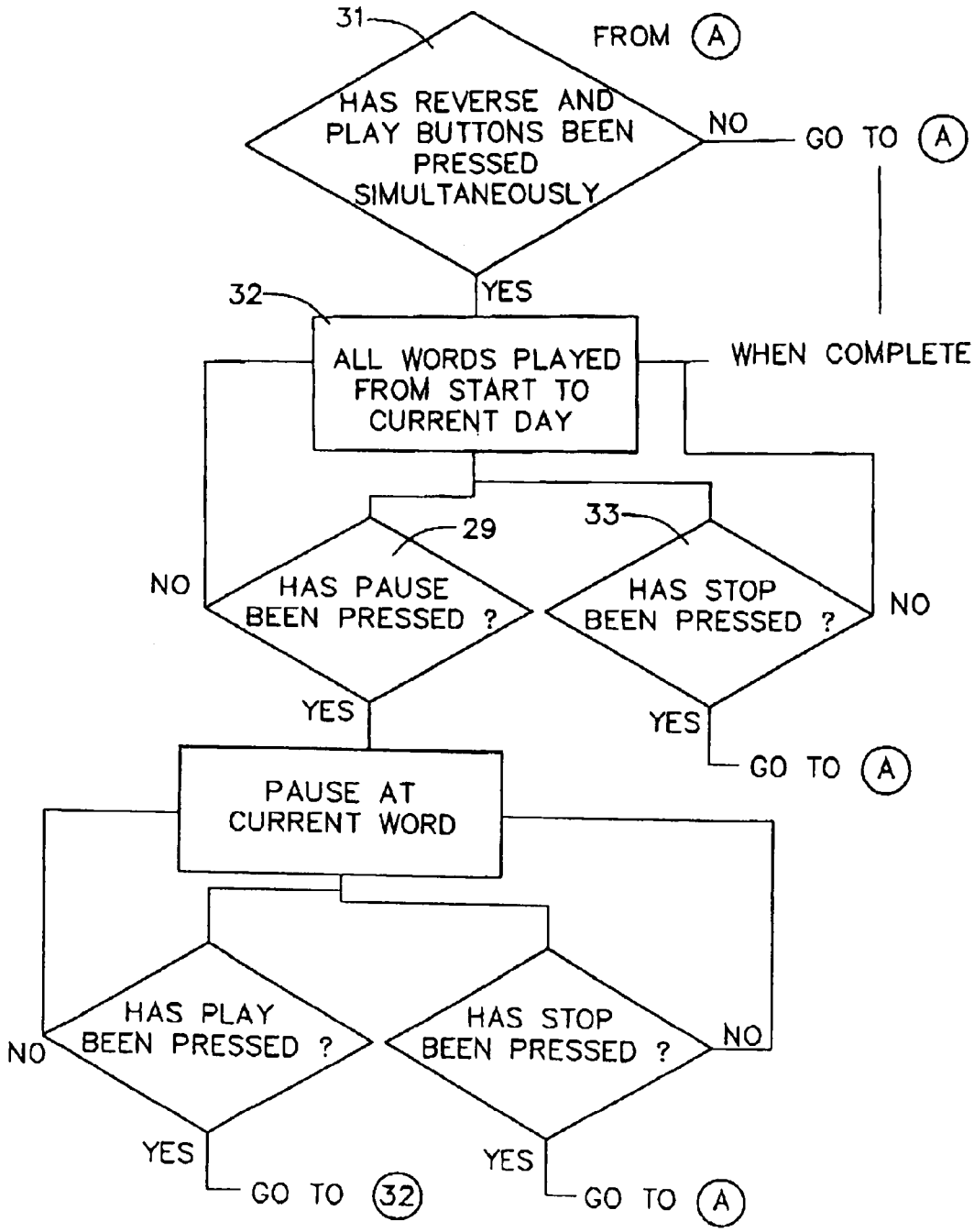
Figure 4:
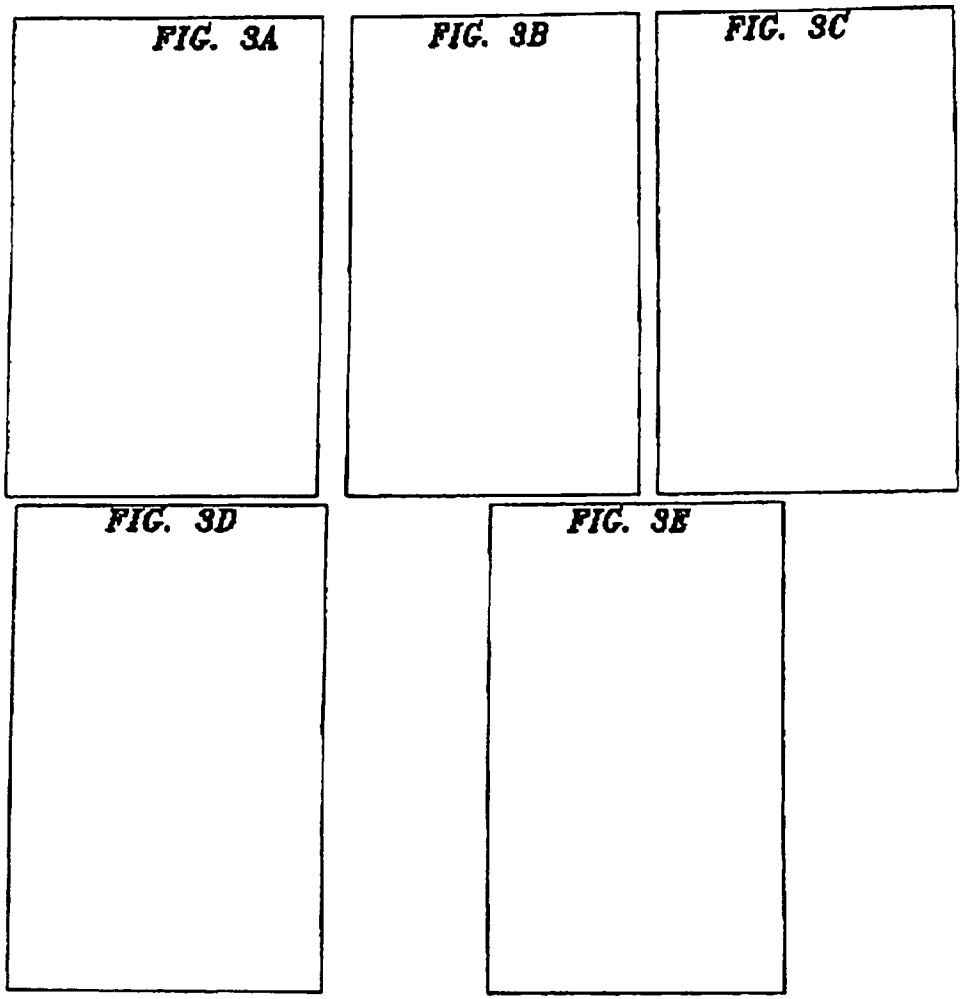
FIG. 4 is a diagram showing the correct arrangement of FIGS. 3A through 3E to display the entire flowchart for utilizing the preferred embodiment of the invention.

If reverse 23 and play 41 features are activated simultaneously, each of the words encoded in a set in the memory cartridge 16 (FIG. 2) are played in their respective incrementally stored sequence until the word for the day of activation is displayed 34 (FIG. 3B). This may be done at any time the clock is running 12, both before and after the time of day on which the alarm is set to go off 20, or regardless of whether the alarm 20 is set at all for the day.

Stop control may be activated 33 at any time to stop generating 42 the audio portion of the word. This may be done when words are being replayed, i.e. after the reverse and play controls are activated 31 simultaneously to restart either all words from the beginning of the sequence, or when going back or forward between the words from specific days or even when the alarm first goes off 20 and the word of the day is displayed 21. On stop control activation 33 during alarm operation 20, the audio will continue to sound 42 until the words are complete and the clock 12 will return to normal operation. The play activation 41 will also act as a pause control when the history play 32 and the pre-selected sequence of previously displayed words modes are active.

If the play control is activated 41 at any point in the day when the clock is running 12, the word of the day will be again displayed 21. This can be repeated as many times as desired.

At any time during the day, reverse activation 23 will display 35 the word from the previous day. If the current word is the first word stored on the memory cartridge 16 (FIG. 2), the word displayed 34 (FIG. 3B) will indicate 39 (FIG. 3A) that there are no further words to display. Reverse control activation 23 may be reactivated several times in a row to go back any predetermined number of days that the user desires. After having reversed 23, the forward control activation 25 can be activated to play 36 the next consecutive day's word. Then the user can energize the play control 41 to play the definition for the word. If the user comes to the last word 37 encoded on the memory cartridge 16 (FIG. 2), the display will indicate 40 (FIG. 3C) that there are no additional words to display. If after reversing 23, the user does not activate 25 the forward control, the clock 9 will return to normal operation after a predetermined time.

Thus, there is provided in accordance with the principles of the invention a learning device that combines the physical senses of sound and sight with increments of information that can be readily assimilated and retained by the user. The invention, moreover, is limited only through the scope of the claims appended hereto.

What is claimed is:

1. An educational device for displaying and expressing a sequential set of individual information increments comprising a clock for regulating timed cycle for displaying and expressing the sequential set of individual information increments, a visual display control coupled to said clock for selectively and sequentially displaying one of the individual information increments in the set thereof, an audio control and speaker coupled to said clock for selectively and sequentially audibly expressing said displayed individual information increments, an alarm control coupled to said clock for activating said visual display control and said audio control for displaying and expressing, respectively, at predetermined times the next individual information increment in the set of increments, a snooze control for interrupting the displaying and expressing of the next individual information increment in the set thereof and reactivating said audio control and said visual display control after a selected delay, memory means for storing the sequential set of individual information increments and for coupling said stored increments to said visual display control and to said audio control, a play control coupled to said visual display control and to said audio control for combination therewith to terminate said visual display and said audible expression of the individual information increments in the set, a reverse control coupled to said visual display control and to said audio control for activation with said play control to repeat at least some of the sequence of the information increments in the set thereof, and a forward control coupled to said visual display control and to said audio control for displaying and expressing the sequentially next information increment in the set thereof.

2. An educational device according to claim 1 wherein said reverse control further enables said visual display control and said audio control to display and express the individual increment of information in the set that immediately precedes said selectively displayed one of the information increments in the set.

3. An educational device according to claim 1 further comprising a stop control coupled to said audio control for deactivating said visual display control and said audio control and to enable said clock to restore said timed cycle for displaying and expressing the sequential set of individual information increments.

4. An educational device according to claim 1 further comprising a volume control coupled to said audio control for regulating the volume of one or more of said selectively and sequentially expressed individual information increments.

5. An educational device according to claim 1 further comprising a switch for enabling said audio control to respond to amplitude modulated and frequency modulated radio signals.

6. An educational device according to claim 1 further comprising an alarm set control for enabling said alarm control to activate said visual display control and said audio control selectively for displaying and expressing the individual information increments.

7. An educational device according to claim 1 further comprising an earphone jack coupled to said audio control for enabling said audio control to terminate audibly expressing at least one of the individual information increments in the sequential set thereof.

8. An educational device according to claim 1 further organized so that by activating a snooze control when the alarm is not activated a sequence of functions for a last preceding number of days appears in series on a screen and is expressed audibly.

9. An educational device according to claim 1 further organized so that by simultaneously activating reverse and play controls the entire sequence of functions appears in series on a screen and is expressed audibly.

* * * * *